US005999100A

United States Patent [19]

Wright et al.

[11] Patent Number: 5,999,100

[45] Date of Patent: Dec. 7, 1999

[54] PNEUMATICALLY ACTUATED PATIENT MONITOR HAVING MULTIPLE PULSE GENERATORS

[75] Inventors: Mack Wright, Jacksonville; Bert Wechtenheiser, Ponte Verda Beach, both of Fla.

[73] Assignee: Dwyer Precision Products, Inc., Jacksonville, Fla.

[21] Appl. No.: 09/097,888

[22] Filed: Jun. 15, 1998

Related U.S. Application Data

[63] Continuation-in-part of application No. 08/839,300, Apr. 17, 1997, Pat. No. 5,767,774.

[51] Int. Cl.[6] ..... G08B 23/00

[52] U.S. Cl. ..... 340/573.1; 128/782; 200/51.09

[58] Field of Search ..... 340/573.1, 665, 340/544, 548; 128/782; 200/51.09, 81.5

[56] References Cited

U.S. PATENT DOCUMENTS

| | | | |
|---|---|---|---|
| 3,104,293 | 9/1963 | Rendler | 200/51 R |
| 3,823,285 | 7/1974 | Dwyer | 200/81 H |
| 4,020,482 | 4/1977 | Feldl | 340/573 |
| 4,577,185 | 3/1986 | Andersen | 340/573 |
| 4,583,084 | 4/1986 | Henderson et al. | 340/573 |
| 4,762,968 | 8/1988 | Hilton | 340/573 |
| 5,066,943 | 11/1991 | Demirel et al. | 340/573 |
| 5,155,309 | 10/1992 | Dwyer | 340/573 |
| 5,736,702 | 4/1998 | Roberts et al. | 200/81 H |
| 5,767,774 | 6/1998 | Wright et al. | 340/573 |

*Primary Examiner*—Jeffery A. Hofsass
*Assistant Examiner*—Sihong Huang
*Attorney, Agent, or Firm*—Clifford A. Poff

[57] ABSTRACT

A patient monitoring system incorporating a pneumatic switch which is responsive to a pair of pressure generators, including a first armable pressure generator which is attached to the patient and which is triggered upon movement of the patient beyond a certain range and a second force actuated generator having a portion to which a patient applies pressure.

7 Claims, 7 Drawing Sheets

PNEUMATICALLY ACTUATED PATIENT MONITOR HAVING MULTIPLE PULSE GENERATORS

CROSS REFERENCE TO RELATED APPLICATION

This application is a continuation-in-part of U.S. patent application Ser. No. 08/839,300, Filed Apr. 17, 1997 now issued as U.S. Pat. No. 5,767,774.

BACKGROUND OF THE INVENTION

1. Field of the Invention

The present invention relates generally to a patient monitoring system and more particularly to such a system incorporating a pneumatically actuated switch which is connectable to a nurse call system and which is responsive to multiple pressure generators.

2. Description of the Prior Art

It is known in the art to use pneumatically actuated switches, rather than electrical switches, as part of nurse call systems. Such switches, disclosed for example in U.S. Pat. No. 3,823,285 to Dwyer, are particularly beneficial where combustion concerns may be present, as in oxygen rich environments, because the construction of the switch limits the possibility of arcing which is a problem associated with electrical switching.

However, all known systems involve the use of one pressure generator for creating a pressure pulse associated with one pneumatic actuated switch which is connectable to the receptacle of a nurse call system. Not known in the art is a system incorporating a single pneumatic switch responsive to multiple pressure generators. Such capability is useful for example to provide for the combination of an armable pressure generator attached to a patient which generates a pressure pulse when the patient moves beyond a certain range and a second force actuated pressure generator which generates a pressure pulse in response to pressure applied to the generator by the patient.

Accordingly, it is an object of the present invention to provide a patient monitoring system in which a pneumatically actuated switch is responsive to multiple generators.

It is a further object of the present invention to increase the functionality of a pneumatically actuated switch of a monitoring system for a patient by providing a system in which one switch is responsive to multiple pneumatic pulse generators thereby allowing for a generator associated with a perimeter monitor for the patient and another generator associated with a nurse call device for the patient.

It is yet another object of the present invention to increase the capability of a nurse call system for multiple patients by providing a system in which one pneumatically actuated switch is responsive to multiple pneumatic pulse generators thereby allowing for separate generators associated with nurse call devices for separate patients connected to a single receptacle of a nurse call system.

SUMMARY OF THE INVENTION

According to the present invention, there is provided a patient monitoring system. The system includes the combination of a plurality of pneumatic pressure generators for generating pneumatic pulses, each generator being actuable by a patient; conduit including a central control line joined to branch lines in a fluid conducting relation with the plurality of pneumatic generators; and a pneumatic actuated switch acted upon by pneumatic pulses delivered by the central control line from any of said pneumatic generators.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
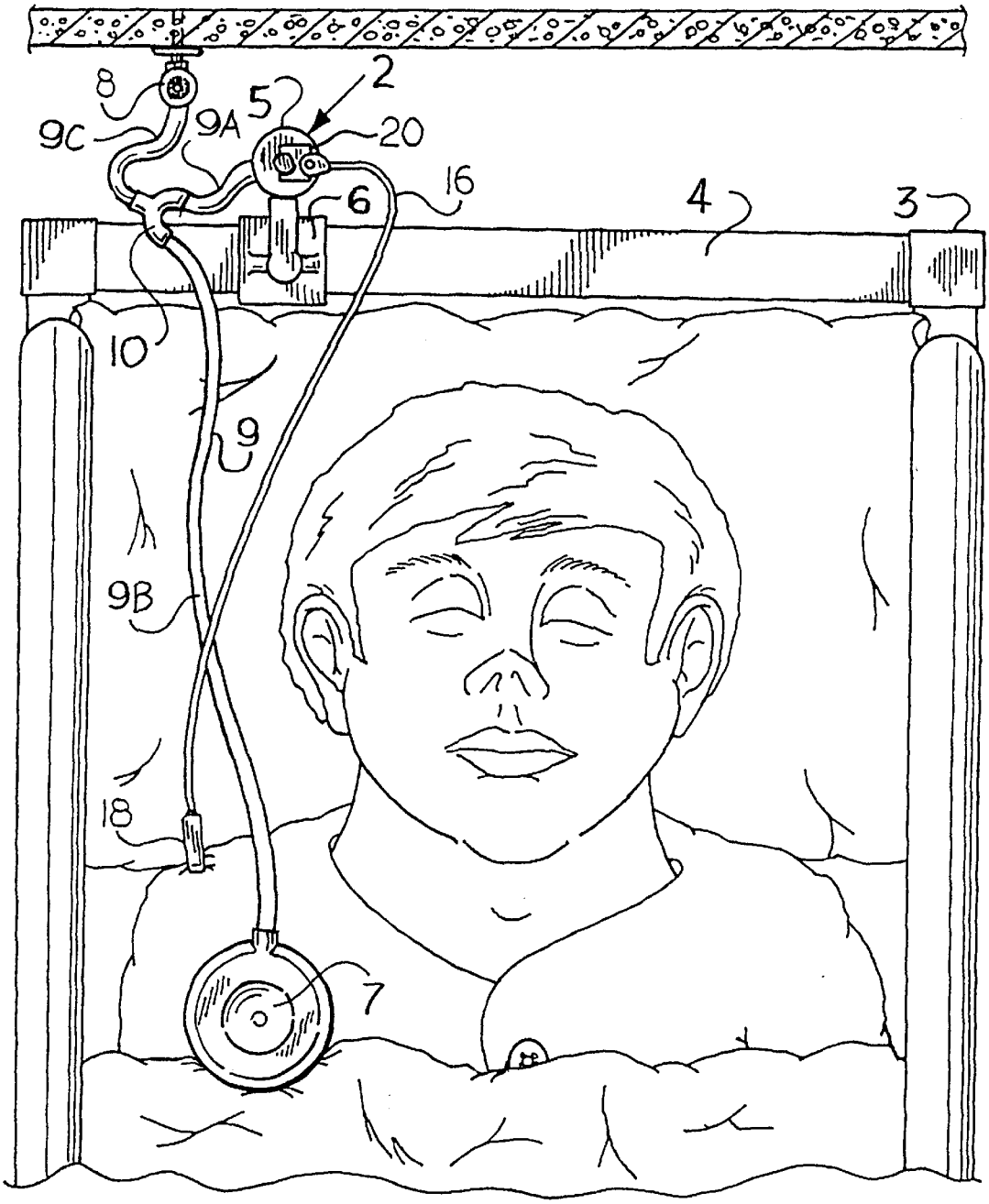
FIG. 1 is a plan view of a patient bed incorporating a monitoring system according to the present invention.
Figure 2:
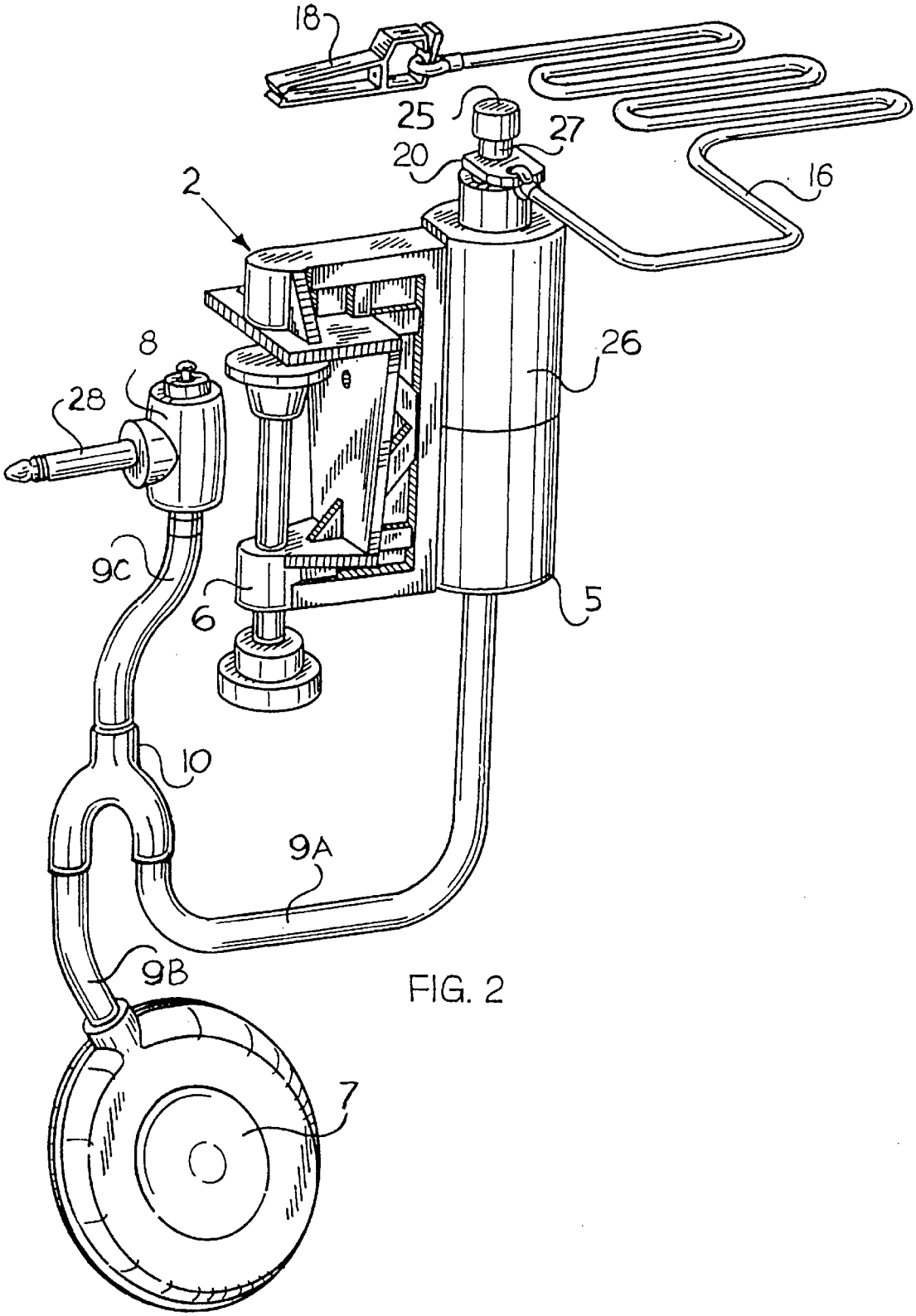
FIG. 2 is a perspective view of the monitoring system of FIG. 1.

FIGS. 1 and 2 illustrate a multiple generator patient monitoring system 2 according to the present invention to signal alternatively upon movement of the patient beyond a certain range or in response to signaling by the patient. Referring to FIG. 1, there is shown a plan view of a patient situated on a patient bed 3 having a cross rail 4. The monitoring system 2 includes an armable pneumatic pressure generator 5 attached to cross rail 4 through mounting clamp 6 and triggered upon movement of the patient to generate a pressure pulse as will be described in greater detail. The system also includes a force actuated pneumatic pressure generator actuated by pressure applied by the patient to generate a pressure pulse, shown in the preferred embodiment as squeeze bulb 7 per se well known in the art as disclosed in U.S. Pat. No. 5,155,309 to Dwyer. A pneumatic switch 8, shown in FIG. 1 connected to a wall receptacle of a nurse call system, is responsive to pneumatic pulses generated by either of pneumatic generator 5 and squeeze bulb 7 to signal a nurse or other care giver that the patient needs assistance.

Pneumatic tubing 9 carries air pulses to switch 8 from generators 5 and 7 via y-connector 10. As seen in FIGS. 1 and 2, y-connector 10 interconnects branch lines 9A and 9B from generator 5 and squeeze bulb 7, respectively with central control line 9C from switch 8 such that an air pulse emanating from either of generator 5 and squeeze bulb 7 will be directed through y-connector 10 to switch 8. A tether 16 of nylon or other suitable material connects the patient to generator 5 through garment clasp 18 located at one end and trigger clip 20 located at the opposite end. The length of tether 16 is most preferably approximately 5 feet.

Turning to FIG. 2, the perspective view shows in greater detail the construction of the monitor system 2. The pneumatic pressure generator 5 has an armable piston 25 extending from an opening in a housing 26, the internal construction of the generator to be discussed in greater detail below. The piston 25 is maintained in an armed position by the U-shaped trigger clip 20 which fits within a groove 27 in the piston 25. The clip 20 functions as a trigger for activation of the pneumatic pressure generator upon the removal of the clip from the groove 27 of piston 25. The mounting clamp 6 extends from the housing 26 of the pneumatic pressure generator and is constructed for mounting the generator to a variety of locations. The garment clasp 18, connecting the patient to generator 5 at the end of tether 16 opposite trigger 20, may be attached to clothing of the patient.

The monitor shown in FIGS. 1 and 2 functions in the following manner. With the pneumatic pressure generator attached through the mounting clamp to a suitable location of the bed 3, such as a headboard or railing, the pneumatic switch 8 is connected through plug 28 to a conventional nurse call signal system, or other suitable alarming network. The monitor is then armed by extracting the piston 25 from housing 26 and placing the trigger clip 20 in the piston groove 27 to keep the piston 25 in an extracted position with respect to the housing 26. Once the patient has been positioned in the bed 3, the tether 16 is connected to the patient through the garment clasp 18.

With the monitor now in the armed condition, were the patient to attempt to leave the bed, an activation barrier having a radius equal to the length of tether 16 in an extended condition would be reached. Further movement by the patient beyond the activation barrier will result in the removal of the trigger clip 20 from the armed piston 25 causing retraction of the piston within the housing 26 of the pneumatic pressure generator 5 and release of a pneumatic pulse to the switch 8 via tubing 9 and y-connector 10. The switch 8 is responsive to the pneumatic pulse to send a signal through the plug 28 to a nurse call system to indicate that the patient has moved beyond the activation barrier and may need assistance.

Alternatively, the patient may consciously desire assistance and can signal the care giver through the same switch connection to the nurse call system through squeeze bulb 7. Pressure applied by the patient to squeeze bulb 7 causes compression of a chamber portion of the bulb resulting in a pulse of air directed to the pneumatic switch 8 via tubing 9 and y-connector 10.

Figure 3:
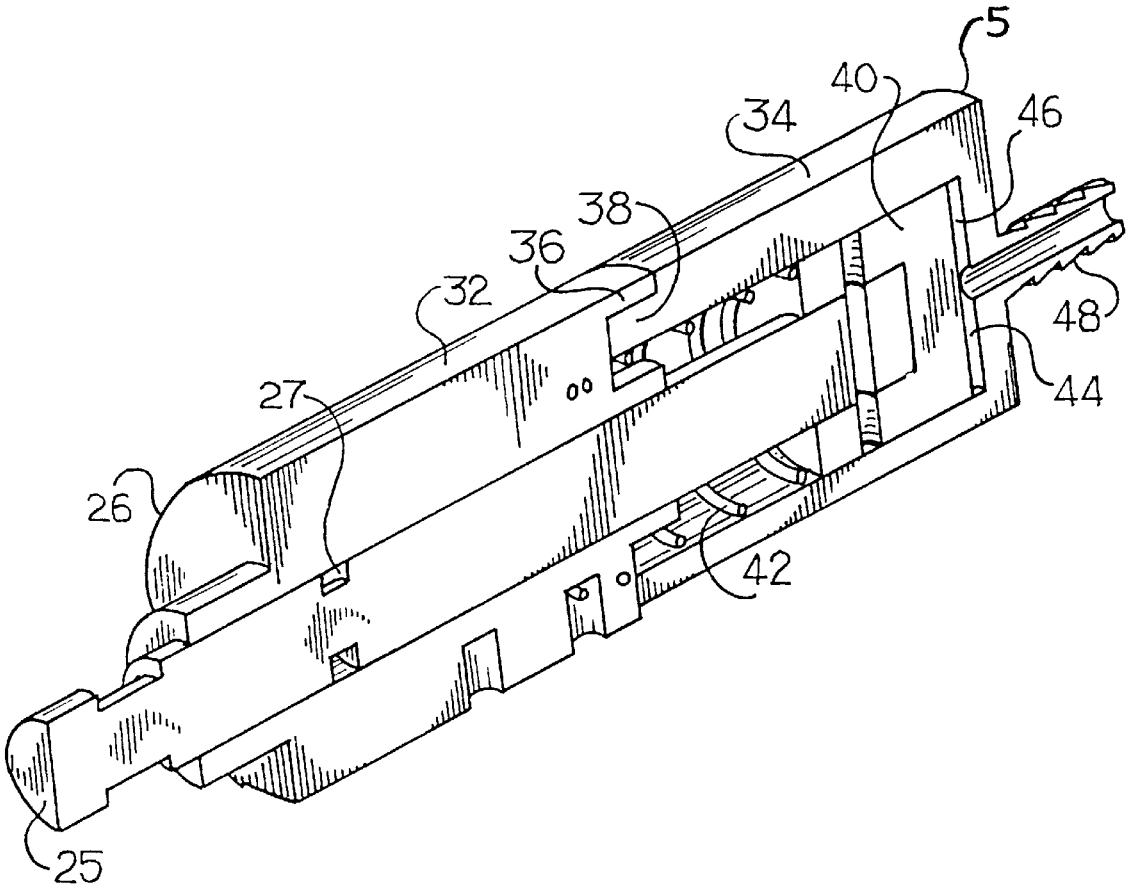
FIG. 3 is a sectional view of the armable pneumatic pressure generator of FIG. 1.

Turning to FIG. 3, there is shown a perspective sectional view of the pneumatic pressure generator 5 of FIGS. 1 and 2. The housing 26 includes an upper housing 32 having an internal opening through which piston 25 extends. The housing 26 also includes a lower housing 34 which is attached to the upper housing through overlapping sections 36 and 38 of the upper and lower housings, respectively. Methods of attachment of the upper and lower housings include an interference fit between the overlapping sections, or by pinned or bolted locations around the circumference of the overlapping portions, or by a combination of both.

As seen in FIG. 3, the lower housing 34 has an internal opening into which the piston extends to a connection with a plunger 40. A spring 42 located within the opening in the lower housing 34 acts between the plunger 40 at one end and the upper housing 32 at an opposite end to provide a force tending to return the piston within the housing after the piston has been extracted for arming. When the trigger clip 20 of FIG. 1 and 2 is removed from the groove 27, the spring 42 forces the piston 25 and the attached plunger 40 back into the internal opening in the lower housing 34. This creates a pressure pulse between an edge surface 44 of plunger 40 and an end face 46 of the lower housing 34 which exits the pressure generator through nozzle 48 to the pneumatic tubing 9 of FIGS. 1 and 2 which is connected to the nozzle.

The plunger 40 must be free to slide within the opening in the lower housing 34 but must be sufficiently close fitting so that an air pulse can be generated in front of the plunger face 46. The tolerance must be sufficient for generation of a pulse of air in front of plunger 40 but need not be unnecessarily close as the pneumatic switch 8 is responsive to low level pressure pulses. The responsiveness of switch 8 to weak pulses is also useful in the present invention to allow for the connection of multiple pressure generators through y-connector 10 without requiring special valving associated with y-connector 9 to prevent pressure losses in inactive sections. For example, when generator 5 is triggered sending a pulse of air to switch 8 via y-connector 10, the pulse pathway associated with the inactive squeeze bulb 7 will remain open.

Figure 4:
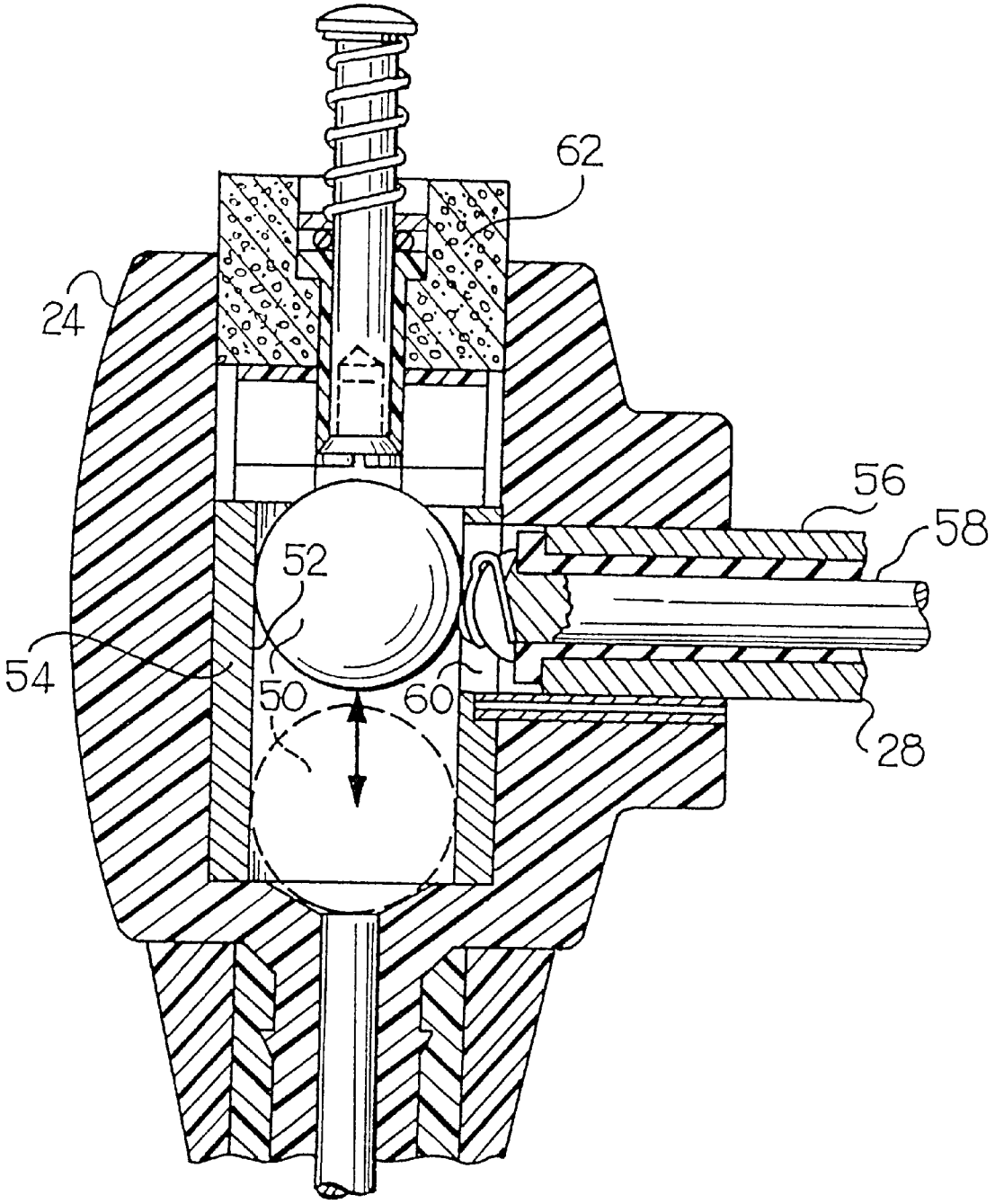
FIG. 4 is a sectional view of the pneumatic switch of FIG. 1.

Turning to FIG. 4, the pneumatic switch 8 of FIGS. 1 and 2 is seen in greater detail. The switch 8 may be constructed in the manner disclosed in U.S. Pat. No. 3,823,285 to Dwyer and such disclosure is incorporated herein by this reference thereto. The switch includes an electrically conductive ball 50 contained within a closely toleranced bore 52 of an electrically conductive sleeve 54. The electrically conductive sleeve 54 is in electrical contact with an external first conductor portion 56 of plug 28. An internal second conductive portion 58 of plug 28, electrically insulated from the first portion, extends through an opening 60 in the conductive sleeve allowing for contact between the ball 50 and the second conductive portion 58 as the ball is driven upwards in the sleeve in response to a pulse of air delivered from the generator 12 via the hose 22. This contact closes an electrical circuit normally open sending a signal through the plug to the nurse call system to which the plug is connected. The porous filter 62 provides for venting of air on the downstream side of the conductive ball 50 allowing the pressure pulse on the upstream side of the ball from the filter to drive the ball upwards into contact with the second conductive portion 58.

Figure 5:
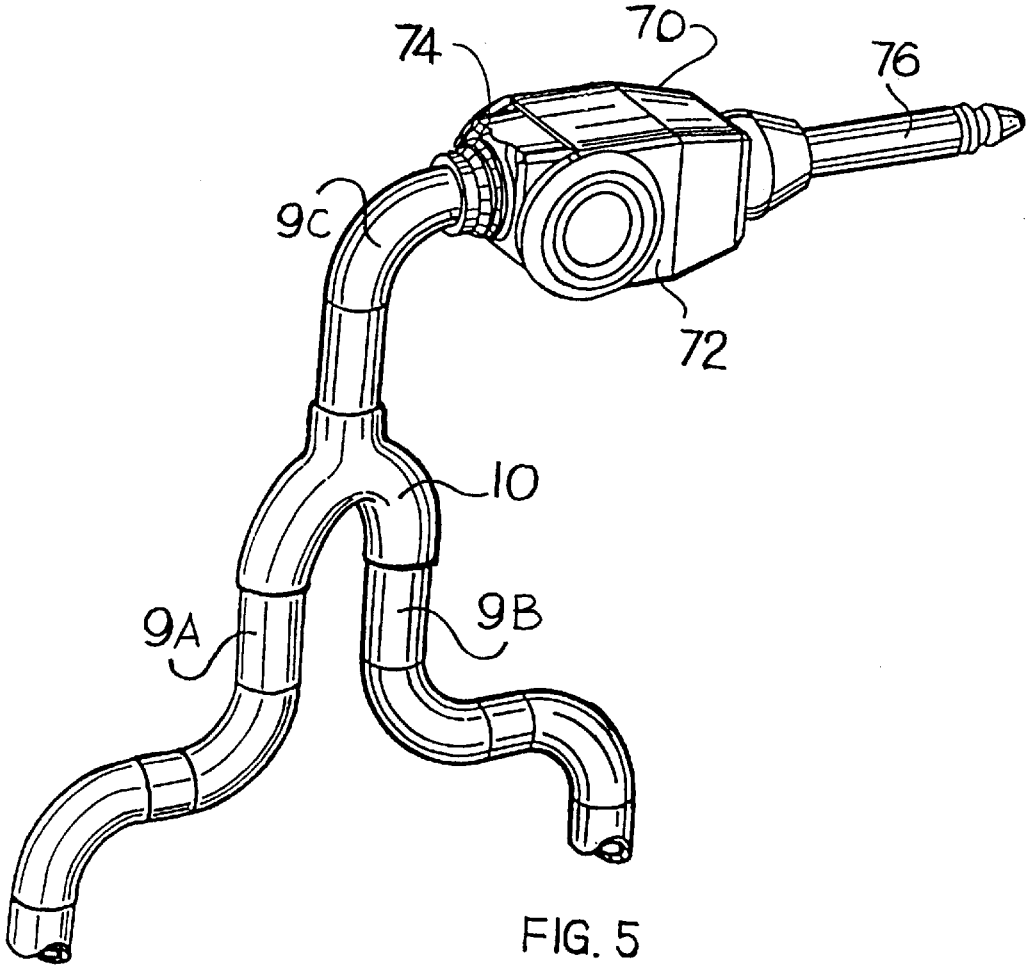
FIG. 5 is a perspective view of an alternative switch to the switch of FIG. 1 having a multiple orientation housing assembly shown in an in-line hose/housing assembly option.
Figure 6:
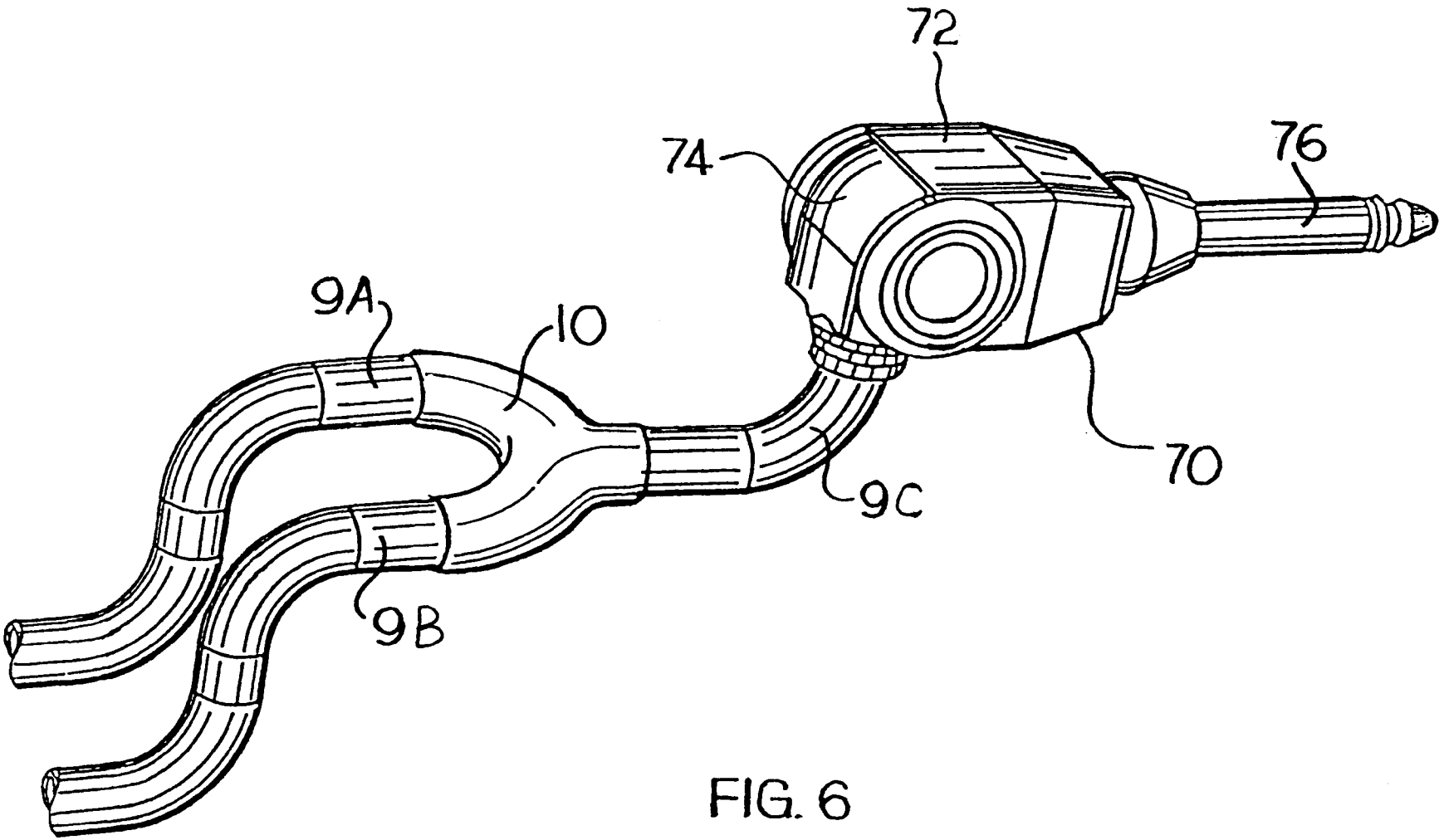
FIG. 6 is a perspective view of the alternative switch of FIG. 5 shown in a right angle hose/housing assembly option.

Referring to FIGS. 5 and 6, there is illustrated a pneumatic switch 70 in a further embodiment of the present invention. The switch 70 which utilizes a conductive plunger may be constructed in the manner disclosed in U.S. Pat. No. 5,736,702 to Roberts and such disclosure is incorporated herein by this reference thereto. The construction of switch 70 allows for multiple angular positions of the switch with respect to the tubing of the system to which it is attached, as seen in the figures in which FIG. 5 illustrates an in-line connection and FIG. 6 illustrates a right angle connection. As was the case with switch 8 of FIGS. 1 and 2, the construction of switch 70 provides for responsiveness of the switch to low pressure pulses of air which is useful in the multiple generator system according to the present invention. Switch 70 includes a housing 72 and a connector 74 which have interfitting surfaces allowing for provision of a pathway for an air pulse through the connector 74 and into the housing 72 in varying orientations of the connector with respect to the housing. The switch includes a plug 76 for connection to the receptacle of the nurse call system seen in FIG. 1.

Figure 7:
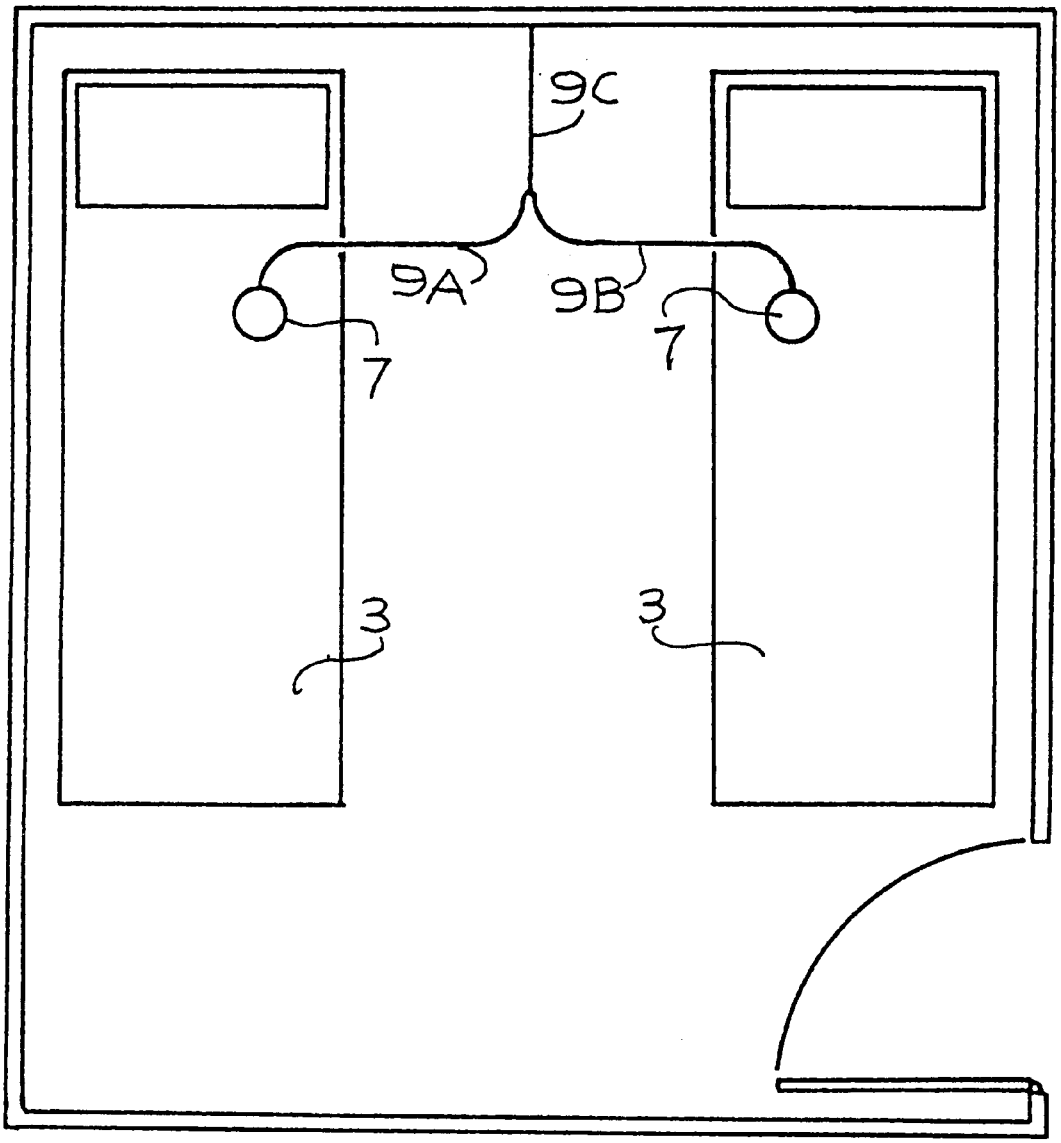
FIG. 7 is a schematic illustration of an embodiment of the present invention having the combination of two squeeze bulb pressure generators.

It is important to note that the present invention is not limited to the combination of FIGS. 1 and 2 having the armable generator 5 and the squeeze bulb 7. The invention is also applicable to other numbers of generators as well as to differing combinations of generators. For example, in FIG. 7 there is illustrated schematically a combination involving two force-actuated squeeze bulbs 7 according to the present invention connected through a single pneumatic switch to the receptacle of a nurse call system.

Although FIG. 1 shows an embodiment of the present invention used in conjunction with a patient located on a bed, it should be noted that the system of the present invention would be equally suited for use in connection with a patient located on other items of furniture such as a chair, for example. When a chair is used to support the patient, the generator will be attached by the clamp mounting portion to a chair rail.

While the present invention has been described in connection with the preferred embodiment of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A patient monitoring system including the combination of:

a plurality of pneumatic pressure generators for generating pneumatic pulses, each generator being actuable by a patient, said plurality including at least one armable pneumatic generator operative in response to a releasable trigger controlled by a tehter connected a patient for generating a pneumatic pulse by releasing said trigger;

conduit including a central control line joined to branch lines in a fluid conducting relation with said plurality of pneumatic generators; and a pneumatic actuated switch acted upon by pneumatic pulses delivered by said central control line from any of said pneumatic generators.

2. The system according to claim 1 wherein said conduit further includes a branched connector for operably connecting said branch lines to said central control line.

3. The system according to claim 1 wherein said at least one armable generator includes a clamp for stationary mounting proximate to a patient bearing area, said releasable trigger being actuated by a patient when the travel of the patient exceeds the length of the tether.

4. The system according to claim 1 wherein said pneumatic pressure generators includes a force-actuated pressure generator having a compressible portion for generating said pneumatic pulse in response to pressure applied by the patient to said compressible portion.

5. The system according to claim 1 wherein said pneumatically actuated switch includes an electrically conductive sleeve having an internal bore in which an electrically conductive ball is slidably contained, said ball being slidable in response to a pneumatic pulse from one of said plurality of pneumatic generators for creating a momentary electrical connection.

6. The system according to claim 1 wherein said pneumatically actuated switch includes a housing which is capable of providing an air passageway for said pneumatic pulses in a plurality of angular orientations of said switch with respect to said connection of said switch to said pressure generators.

7. A patient monitoring system including the combination of:

a plurality of pneumatic pressure generators for generating pneumatic pulses, each generator being actuable by a patient, at least one of said pressure generators actuable in response to movement of a patient beyond a predetermined distance from said at least one pressure generator;

conduit including a central control line joined to branch lines in a fluid conducting relation with said plurality of pneumatic generators; and a pneumatic actuated switch acted upon by pneumatic pulses delivered by said central control line from any of said pneumatic generators.

* * * * *